United States Patent [19]

Lockard

[11] 4,012,608

[45] Mar. 15, 1977

[54] MINIATURE SWITCH WITH SUBSTANTIAL WIPING ACTION

[75] Inventor: Joseph LaRue Lockard, Harrisburg, Pa.

[73] Assignee: AMP Incorporated, Harrisburg, Pa.

[22] Filed: Mar. 25, 1975

[21] Appl. No.: 561,815

Related U.S. Application Data

[63] Continuation-in-part of Ser. No. 498,887, Aug. 20, 1974, abandoned, which is a continuation-in-part of Ser. No. 475,698, June 3, 1974, abandoned.

[52] U.S. Cl. ..... 200/16 D; 200/164 R; 200/76

[51] Int. Cl.[2] ..... H01H 15/08

[58] Field of Search ..... 200/16 C, 16 D, 164 R, 200/164 A, 302, 76, 6 B, 165

[56] References Cited

UNITED STATES PATENTS

| | | | |
|---|---|---|---|
| 2,566,720 | 9/1951 | Dissinger | 200/76 |
| 3,843,852 | 10/1974 | Lockard | 200/164 R |

FOREIGN PATENTS OR APPLICATIONS

| | | | |
|---|---|---|---|
| 1,224,568 | 6/1960 | France | 200/16 D |

*Primary Examiner*—Herman J. Hohauser
*Attorney, Agent, or Firm*—Allan B. Osborne; Gerald K. Kita

[57] ABSTRACT

The invention relates to a manually actuated switch of miniature size wherein a circuit path is completed between poles of the switch by a contact having independent cantilever beams contacting a respective switch pole. The contact is carried by a manually displaceable sliding element in the form of a carriage. Movement of the carriage causes wiping of the cantilever beams over a substantial length of the switch poles. To interrupt the circuit the sliding element is moved to an extreme position whereby one of the beams is slidably traversed off a corresponding switch pole and into abutment against a dielectric projection which prevents chatter of the disengaged beam. Detenting action for precise positioning of the slider element is accomplished by sliding at least one of the cantilever beams over an irregular surface of one of the switch poles. To maximize cantilever beam length, each beam originates on one side of the slider element, projects diagonally across the free space under the slider element and slidably contacts a corresponding switch pole. Since the cantilever beams diagonally bridge across the entire length of the free space under the slider element the beams are of maximum permissible length assuring resiliency over a substantial range of deflection. The component parts of the switch are fabricated for ease in assembly. The switch poles are embedded in a dielectric material which is injection molded to a desired housing shape. The slider element also is injection molded with the contact embedded therein. By forming the contact and the switch poles to desired shapes subsequent to molding, the component parts stack together without a need for hand assembly of the dielectric and conducting component parts.

17 Claims, 34 Drawing Figures

MINIATURE SWITCH WITH SUBSTANTIAL WIPING ACTION

CROSS REFERENCE TO RELATED APPLICATION

This application is a continuation-in-part application of application Ser. No. 498,887, filed Aug. 20, 1974, and is now being abandoned which is in turn a continuation-in-part application of application Ser. No. 475,698, filed June 3, 1974, and now abandoned.

BACKGROUND OF THE PRIOR ART

The advances in solid state electronics has permitted miniaturization of discrete circuit elements and also entire circuits themselves into encapsulated packages adapted for mounting to a printed circuit board. For ease in mounting, the packages have been industry standardized with two rows of depending electrical leads adapted for plugging into apertures of a printed circuit board. Such a package is designated as a dual-in-line package (DIP). Such packaging permits a single printed circuit board to carry multiple electronic circuits fabricated from DIPs with the circuit pads of the board interconnecting the leads on the DIPs for desired circuit configurations. Power is bussed selectively to the circuits through a manual switching device. It is desirable that the switching device be of miniature size and in the DIP configuration for mounting directly to the same printed circuit board. It heretofore has been a difficult task to fabricate a switch of such size.

Encapsulation of DIP elements is required for resisting damage and contamination. Encapsulation of a siwtch of small size is difficult since a manually actuated operator must remain exposed and thereby provide a leakage path to the internal parts of the switch.

A circuit path is completed through a miniature switch by contact pressure between electrically conducting parts of the switch. The required pressure is created by deflecting either a resilient contact or one of the poles of the switch. In addition wiping action of the contact surfaces is desirable to assure electrical contact. Such wiping action is produced in prior art switches by deflection of the contact while engaged against one of the switch poles, forcing the contact to wipe as deflection is increased. In a switch of miniature size the resilient contacts become permanently deformed after repeated deflections thereof since the required contact pressure is created by deflecting a relatively short length of contact.

BRIEF DESCRIPTION OF THE PREFERRED EMBODIMENTS

According to the present invention excessive deflection of the conducting resilient parts of the switch is eliminated. The resilient contacts of the switch are made as long as possible to permit a wide range of resilient deflection and to resist permanent deformation. The desired electrical engagement and wiping action of the contact over the switch poles is accomplished by slidably displacing the contact over the switch poles during a switching operation without a need for positively camming or deflecting the contact. As a further feature of the present invention the switch low profile is obtained by vertically compressing and stacking together the component parts of the switch and utilizing only horizontal sliding displacement of the component parts relative to one another to produce the desired switching operation and contact wiping action.

Detenting action at each of the circuit-make and circuit-break positions is provided by traversing the contact over a surface irregularity of the switch pole. Camming of the contact occurs only during a circuit break condition and such camming occurs only in an amount sufficient to prevent chattering of the contact subjected to vibration. Accordingly the present invention eliminates the need for variable camming or deflection of the switch contact or switch poles and thereby eliminates permanent deformation of the contact experienced in miniature switches of the prior art.

Since vertical traverse of every switch component is substantially eliminated, the switch operator or slide element can be made flush with or even recessed from the top of the switch, permitting the application of a pressure sensitive tape over the top of the switch to serve as an inexpensive contaminant cover which is readily removed and reapplied as desired.

As a further feature of the present invention, the switch is designed to prevent engagement of dielectric parts with the contact surfaces of the electrically conducting parts in order to prevent excessive wear or surface contamination of the conducting parts.

OBJECTS OF THE PRESENT INVENTION

It is therefore an object of the present invention to provide a manually actuated miniature switch of minimum height and in a configuration whereby the switch poles are arranged in spaced rows corresponding to a dual-in-line package.

Another object of the present invention is to provide a dual-in-line package configuration switch wherein the component parts thereof are assembled in stacked relationship and wherein a solely horizontal displacement of a slide element or carriage produces a switching operation as well as a substantial wiping engagement of a contact over the surfaces of the switch poles.

Another object of the present invention is to provide a miniature switch in a dual-in-line package configuration wherein minimum height of the package is provided by utilizing only a horizontal displacement of a sliding element or carriage to provide the desired switching action and a substantial wiping engagement of the switch contact over the surfaces of the switch poles.

Another object of the present invention is to provide a miniature switch with a dual-in-line package configuration wherein purely horizontal displacement of the switch carriage or sliding element accomplishes a switching operation without a need for forcibly deflecting the switch contact into either circuit-make or break positions.

Another object of the present invention is to provide a manually actuated switch of miniature size in a dual-in-line package configuration with the switch carriage or slide element being limited to solely horizontal displacement and with the switch operator either flush with or recessed below the top surface of the switch enabling the application of a pressure sensitive tape on the switch top surface to provide a contaminant cover.

Another object of the present invention resides in a miniature switch of dual-in-line package form wherein the electrically conducting contact surfaces of the switch component parts are prevented from engaging dielectric parts of the switch to prevent contamination and excessive wear of the surfaces.

Other objects and many attendant advantages of the present invention will become apparent upon perusal of the following detailed description taken in conjunction with the accompanying drawings.

BRIEF DESCRIPTION OF THE DRAWINGS

FIG. 3 is an enlarged plan of the contact of the switch.

DETAILED DESCRIPTION OF THE PREFERRED EMBODIMENTS

Figure 1:
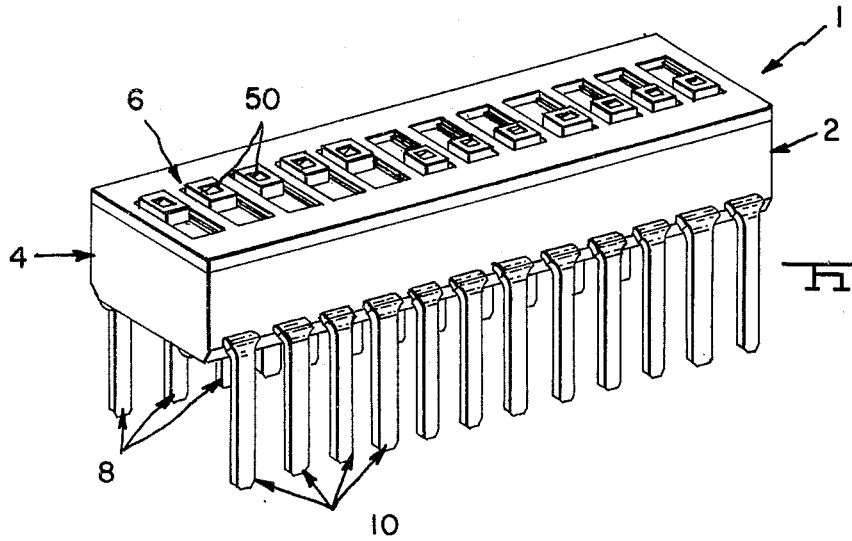
FIG. 1 is an enlarged perspective of a preferred embodiment of a switch according to the invention.
Figure 2:
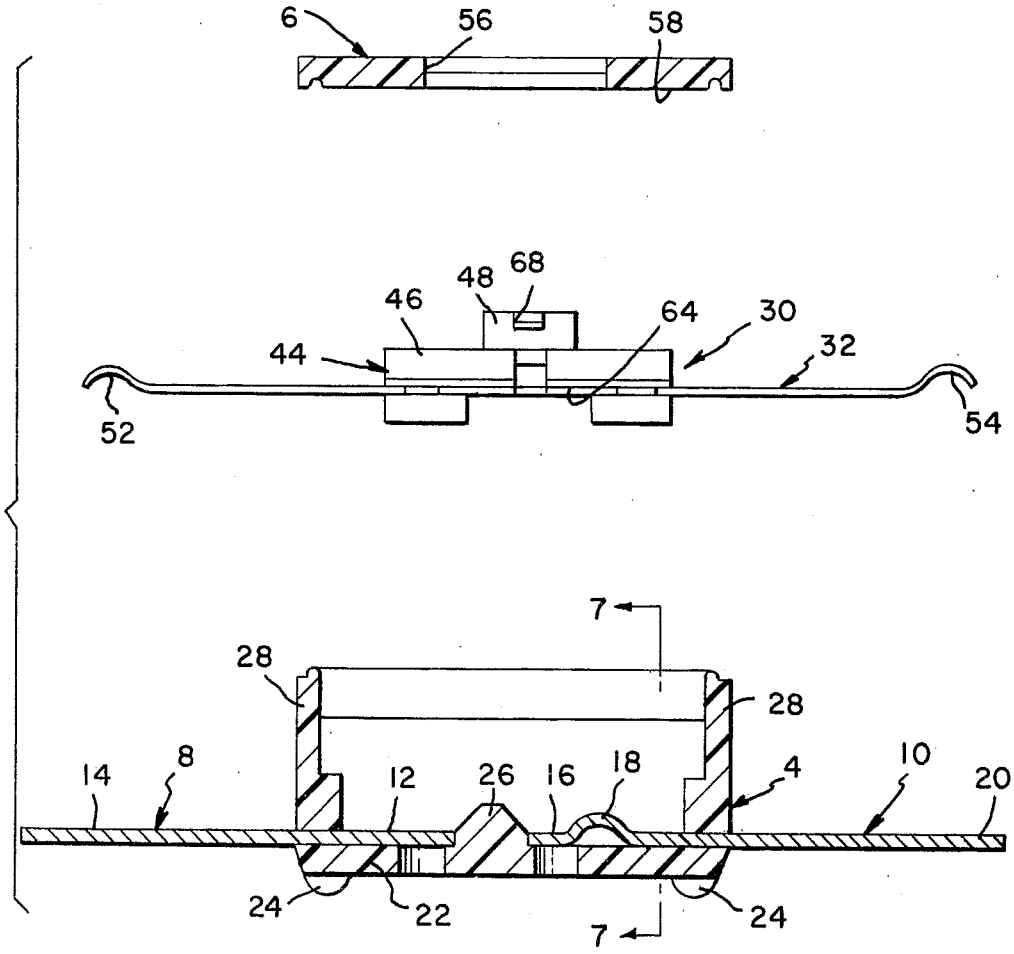
FIG. 2 is an enlarged elevation with parts in section and in exploded configuration to illustrate the details thereof.
Figure 4:
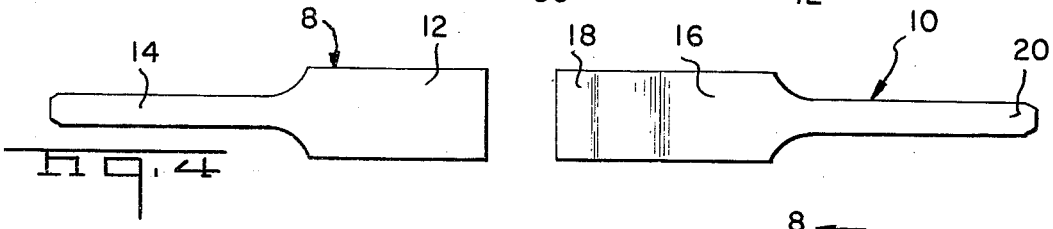
FIG. 4 is an enlarged plan of the terminals of the switch.

With more particular reference to the drawings there is shown in FIGS. 1 and 2 a miniature switch 1 according to the present invention. The switch includes a housing illustrated generally at 2 comprising a dielectric base portion 4 and a dielectric cover 6. The housing 4 contains two rows of terminals 8 and 10 arranged in opposed pairs. The details of the terminals 8 and 10 are shown in FIG. 4. Terminal 8 includes a first end portion 12 which is relatively wide and elongated to provide a planar contact surface. An opposite end 14 of the contact 8 is relatively narrow in order to form a pluggable lead. Similarly contact 10 includes a relatively wide and elongated planar contact surface at one end 16. A generally arcuate raised or projecting portion 18 is formed in the end portion 16 to provide a detent feature as will be explained in detail. An opposite end 20 of the terminal 10 is relatively narrow and elongated to form an electrical lead.

As shown in the FIGS. 1 and 2 the contacts 8 and 10 are mounted with their ends 12 and 16 adjacent but spaced from one another and against a planar bottom wall 22 of the housing 4. The bottom wall 22 is provided with inverted projecting feet 24 to provide standoffs when mounting the housings 4 to a printed circuit board. The bottom wall further includes an integral tapered projecting portion 26 disposed generally between the contacts 12 and 16. The housing 4 further includes opposed elongated sidewalls 28 which are integral with the bottom wall 22. Advantageously the housing 4 is fabricated by molding a dielectric material with the contacts 8 and 10 being embedded in the sidewalls 28 during the molding process. Such a process assures precise location of the terminals 8 and 10 which have their end portions 14 and 20 projecting outwardly of the housing 4 to allow for subsequent bending of the end portions 14 and 20 to form depending leads arranged in rows corresponding with a standard dual-in-line package.

As shown more particularly in FIG. 2 the switch further includes a slider element or carriage indicated generally at 30. The carriage is provided with an electrically conducting contact element 32 which is more particularly shown in FIG. 3. The contact element 32 includes a pair of enlarged central portions 34 connected together by an integral web 36. A first resilient beam 38 projects outwardly from one of the portions 34 and is offset from the central axis 40. In similar fashion a resilient beam portion 42 is integral with the other portion 34 and is offset in an opposite direction from the central axis 40. As shown more particularly in FIGS. 2 and 3, the portions 34 are embedded within an enlarged central portion 44 of the carriage. The central portion 44 includes a planar top surface 46 provided thereon with an integral projecting knob or operator 48. The knob includes a central recess 50 therein. The carriage 30 is advantageously formed of a moldable dielectric with the contact 32 having its central portions 34 molded integrally or embedded therein. The beam portions 38 and 42 of the contact 32 project outwardly of the carriage portion 34 and have the ends 52 and 54 thereof formed into an arcuate or bowed configuration. As shown more particularly in FIGS. 5 and 8, the projecting resilient beams 38 and 42 are bent around the bottom of the carriage body 44 to project across the bottom of the carriage body and outwardly in diagonal fashion. Since the beams 38 and 42 are offset in opposite directions from the axis 40 they are allowed to extend in opposite diagonal directions while being adjacent each other without touching. The carriage body 44 is mounted with the housing between the sidewalls 28 with the resilient beams 38 and 42 engaging respectively the terminals 10 and 8. The beams 38 and 42 extend diagonally in the free space between the carriage and the terminals 8 and 10 and also are continuously interposed between the carriage and the terminals to prevent engagement therebetween.

The cover 6 is molded from a dielectric material and is provided with a generally central elongated slot 56. The cover 6 is assembled over the ends of the sidewalls 28 with the knob or operator 48 being received within the confines of the slot 56. The cover is further molded with an inverted planar sliding bearing surface 58 which engages against the planar surface 56 of the carriage. Where the cover abuts the sidewalls 28, the seams thereof may be sealably closed with an amount of adhesive. The cover thus overlies the carriage 30 maintaining the component parts of the switch in vertical stacked relationship and in abuttment with one another. Since the beams 38 and 42 project diagonally across the bottom of the carriage body portion they are of maximum length to assure their resiliency over a relatively wide range of deflections. The beams 38 and 42 are therefore able to resiliently absorb a selected amount of vertical compression when the component parts of the switch are assembled and maintained in the stacked configuration as shown in the drawings. In addition such resilient action of the beams provides considerable contact pressure between the arcuate end portions 52 and 54 with the terminals 10 and 8, thereby completing an electrical circuit from the terminal 8, through the beam 42, to the beam 38 and through the terminal 10.

Figure 7:
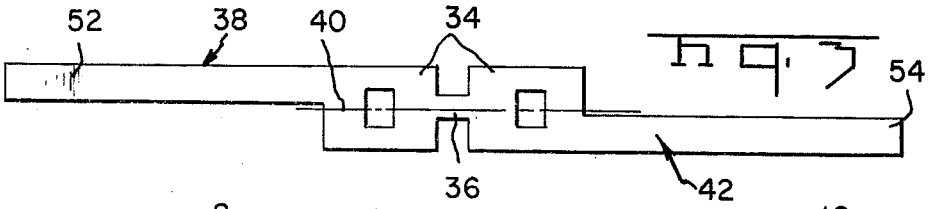
FIG. 7 is an enlarged fragmentary section along the line 7—7 of FIG. 2.

To complete the details of the switch reference will be made to FIGS. 7 and 8. The base portion 4 includes a plurality of partition walls 60 interposed between each corresponding pair of contact 8 and 10, thereby separating the contacts 8 and 10 into discrete pairs. As shown a partition 60 forms also an end wall for the switch housing 2. Each partition 60 is provided with a pair of shoulders 62 forming planar sliding bearing surfaces. The carriage body 44 is provided with complementary inverted shoulders 64 adapted to overlie the bearing surfaces 52. Thus as shown more particularly in FIGS. 5 and 8, the carriage body portion 44 is constrained in the vertical direction between the bearing surface 58 of the cover 6 and the bearing surfaces 62 of the partitions 60. The inherent resiliency of the beams 38 and 42 resiliently urge the carriage body portion 44 to impinge against the inverted bearing surface 58. The amount of vertical travel of the carriage between the bearing surfaces 58 and 62 can be precisely controlled. For example it may be desirable to allow a slight vertically downward motion of the carriage when the operator or knob 48 is manually engaged to actuate the switch in a manner to be described. In that case a clearance may be provided between the bearing surfaces 58 and 62 to allow for such motion. The inherent long length beams 38 and 42 assure that they will resiliently absorb such movement without becoming permanently deformed by excessive deflection thereof.

Figure 8:
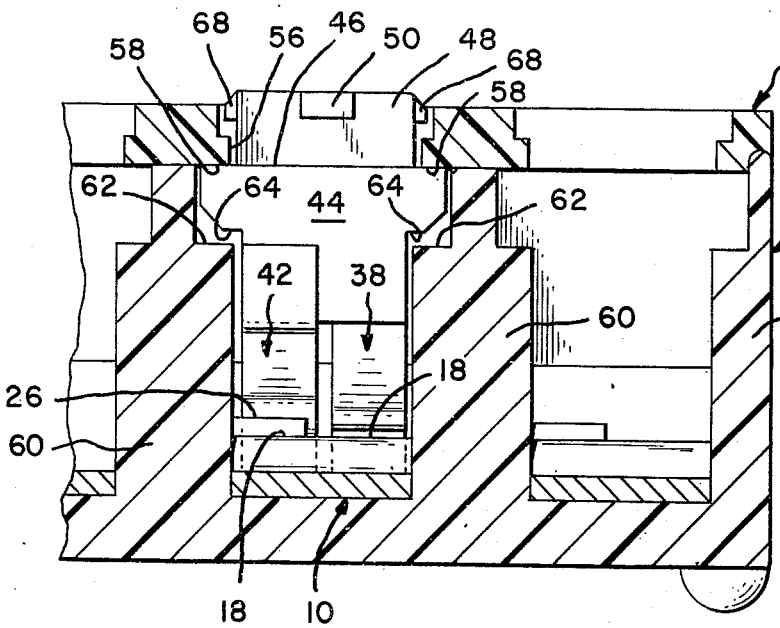
FIG. 8 is an enlarged fragmentary section along the line 8—8 of FIG. 5.

As an alternative feature, the slot 56 of the cover 6 may be of step configuration as shown in FIG. 8. The knob 48 may be optionally provided with ears 68 which are readily resiliently compressed to allow forcible receipt of the knob 48 into the slot 56. The ears therefore register within the enlarged portion of the stepped slot to prevent inadvertent withdrawal of the knob from the slot. Such a feature allows for versatility in assembling the switch. The carriage may be first assembled into the cover with the ears holding the carriage in desired location. Alternatively the carriage may be mounted in stacked relationship over the terminals 8 and 10 and the cover subsequently forcibly inserted over the ears. Alternatively the ears may be eliminated to permit free receipt of the knob within the slot 56. Operation of the switch according to the present invention will be described by reference to FIGS. 5, 6, and 8. The carriage 44 is adapted for slidable displacement within the housing with the bearing surfaces 58 and 62 constraining the carriage to move solely in a horizontal direction or plane. Actuation of the switch is accomplished, for example by manually grasping or utilizing a pointed tool in registration within the recess 50 of the knob 48 and slidably displacing the knob 48 as desired within the slot 56. Since displacement of the carriage is confined to a horizontal plane or direction. The height of the switch is substantially reduced by comparison to prior art switches wherein a vertical component of motion occurs or is required. In addition the beams 38 and 42 are slidably traversed to provide a wiping engagement over a substantial length of the terminal surfaces 8 and 10 without a need for positively camming or deflecting the contacts during a switching operation to provide either the electrical engagement or wiping action. Thus as the carriage slidably displaces the beams 42 and 38 establish a desired electrical engagement and provide a wiping action without a need for further camming or addtionally deflecting the beams. The beams accordingly are not subject to permanent deformation as are the deflectable conducting parts of prior art switches. In addition a desired electrical circuit is completed by the described electrical engagement and wiping action throughout a substantial displacement of the carriage.

Figure 6:
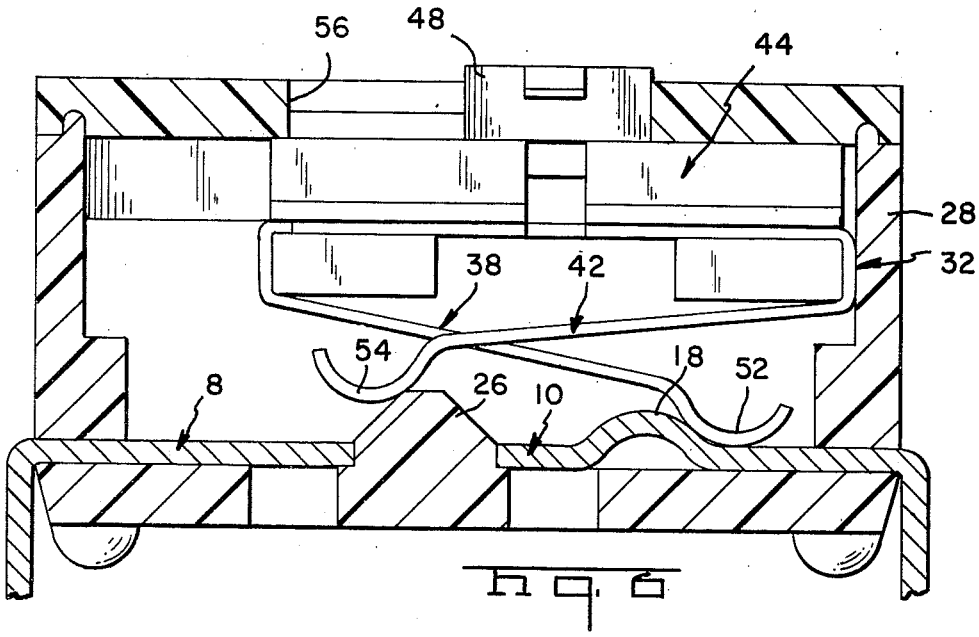
Figure 7:
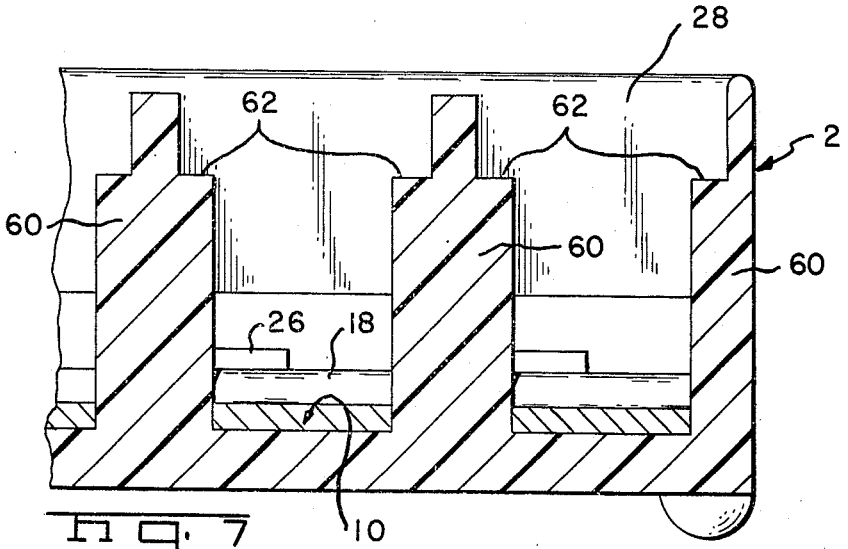

As shown in FIG. 6, the carriage 48 may be displaceable to an extreme position at one end of the slot 56 in order to interrupt the established electrical circuit between the terminals 8 and 10. More particularly, the electrical circuit continues to be completed as the switch is displaced either toward or away from its extreme position as shown in FIG. 6. However when the switch is in the extreme position as shown, one of the beams, namely beam 42 will slide off the end of the terminal 8 thereby becoming disengaged from the terminal 8 and thereby interrupting the circuit established between the terminals 8 and 10. It is to be noted that circuit interruption is accomplished merely by displacing the entire beam 42 without a need for deforming or deflecting the beam 42. Such a switching operation is a substantial improvement over the prior art switches wherein repeated deflection of conducting component parts to interrupt an electrical circuit resulted in permanently deforming the deflected parts.

It has been found desirable that when the beam 42 is disengaged from the terminal 8 there should be provided a technique to prevent chattering of the beam 42 when the switch is subjected to vibration. Accordingly the integral tapered projection 26 of the base is provided adjacent the end of the terminal 8 such that the beam 42 will register against the projection when the switch carriage is in its selected position as shown in FIG. 6. As shown in FIG. 6 the sizes of the projection is greatly exagerated for clarity. It is not necessary to cause substantial deflection of the beam 42 when the beam is engaged against the projection. Instead it is only desirable that the arcuate end 54 be supported in free space defined between the carriage and terminals by engagement against the projection, rather than being left free to chatter when the switch is subjected to vibration. A desired detenting action of the carriage when in its selected position as shown in FIG. 6 is provided by the arcuate raised portion 18 of the terminal 10. More specifically as the carriage is displaced toward its selected position the arcuate beam end 52 traverses over the surface of the terminal 10 and accordingly over the arcuate raised portion 18. When the carriage is located at its selected position as shown in FIG. 6 the arcuate portion 52 will register against one side of the arcuate raised portion 18 to provide a detenting action. In addition, one of the sidewalls 28 is engaged by a portion of the contact 32 which overlies an end of the carriage 44 to provide an additional detenting action. Alternatively, the carriage 44 itself may be used to stop against the sidewall 28 to provide the detenting action.

It is expressly a feature of the present invention that the contact surface of the arcuate end portion 54 is not contacted by the dielectric projection 26. Accordingly that portion of the surface of the arcuate portion 54 which slidably wipes over the surface of the terminal 8 remains free of engagement or possible contamination by any of the dielectric portions of the switch. The beams 38 and 42 themselves continuously prevent contact between the dielectric carriage 44 and the surfaces of the terminals 8 and 10 to prevent their possible engagement by and contamination by the dielectric portions of the switch. It is a further feature of the invention that immediately upon displacement of the carriage from its selected position as shown in FIG. 6 the beam end portions 54 and 52 will engage and wipe over the surfaces of the terminals 8 and 10 to assure the electrical engagement and wiping action desired.

Figure 5:
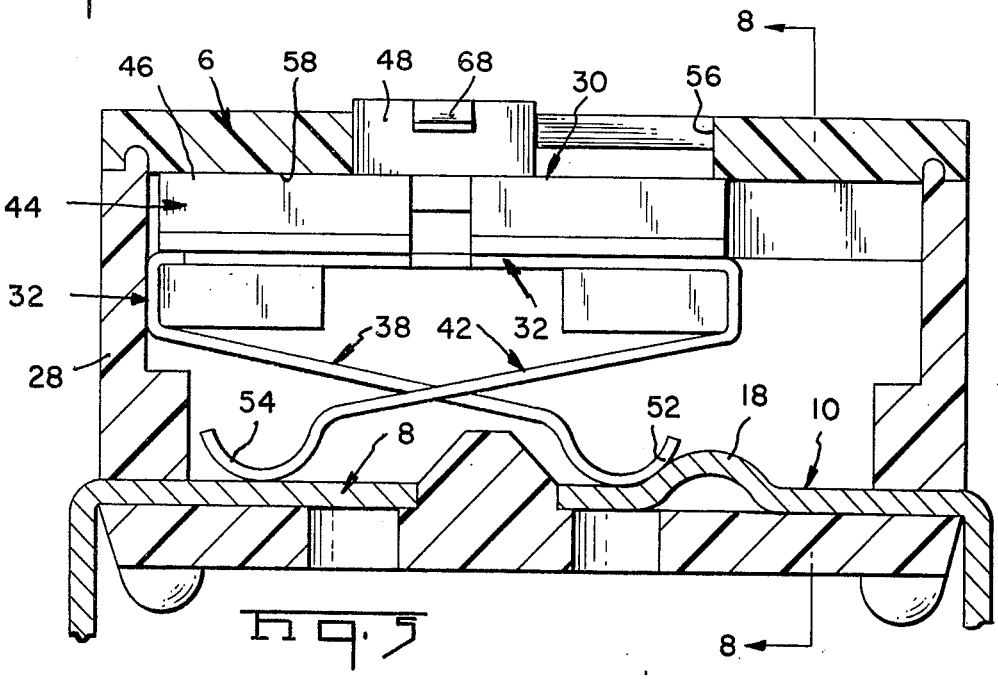
FIG. 5 and 6 are enlarged elevations in section of the switch of FIG. 1 illustrating the modes of operation.

If it is desired to provide a detenting action for the switch in its position in FIG. 5, the sidewall 28 may be utilized as a stop for a portion of the contact 32 which overlies an end of the carriage 44. In addition the arcuate end portion 52 of the beam 38 may be slidably wiped over the surface of the arcuate projecting portions 18 for registration against another side of the projecting portion 18.

Figure 9:
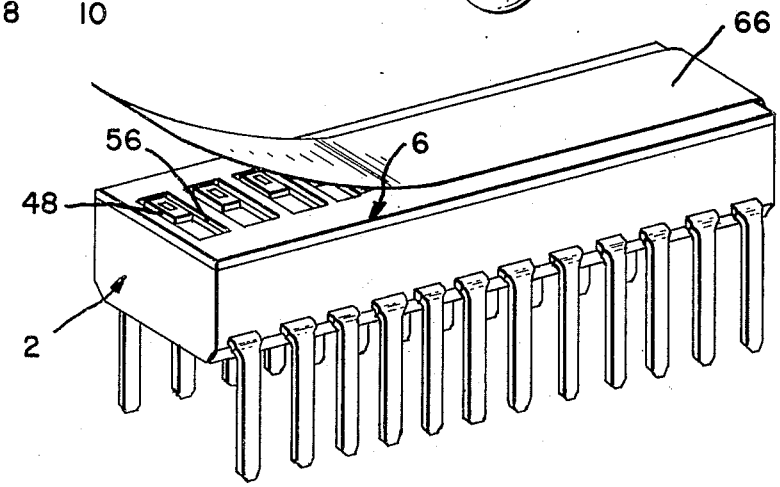
FIG. 9 is an enlarged perspective of a modification of the switch of FIG. 1.

For an additional feature of the present invention reference will be made to FIG. 9. In the embodiment of the invention it is shown in FIGS. 1–8, the knob 48 is illustrated as projecting slightly outward of the top surface of the cover 6. It is a simple matter to modify the height of the knob 48 or the thickness of the cover 6 such that the knob 48, although received within the confines of the block 56 will remain either flush with or recessed below the top surface of the cover 6. This permits an even lower profile for the switch housing 2 and also permits the application of a length of pressure sensitive adhesive backed tape 66 adhered to the top surface of the cover 6 in order to provide a contaminant cover for the slots 56 of the cover and the knobs 48. The tape 66 is readily removed and reapplied as desired.

Figure 10:
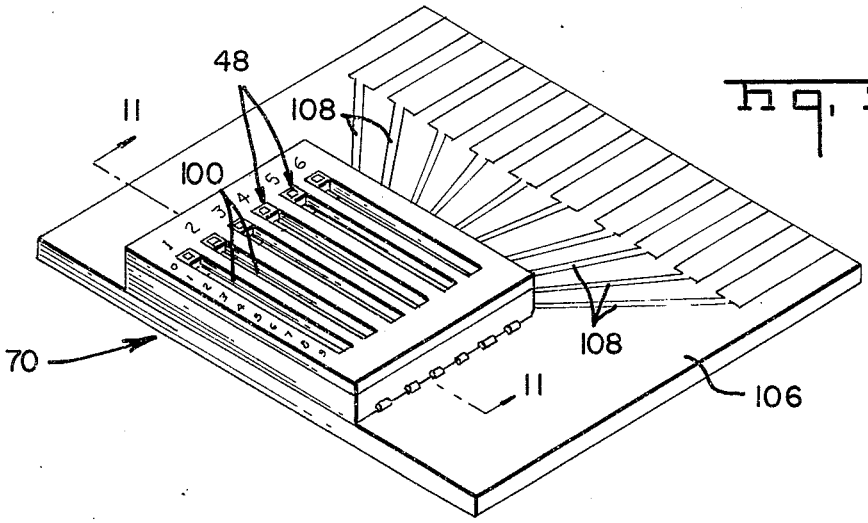
FIG. 10 is a perspective of another preferred embodiment according to the present invention.
Figure 11:
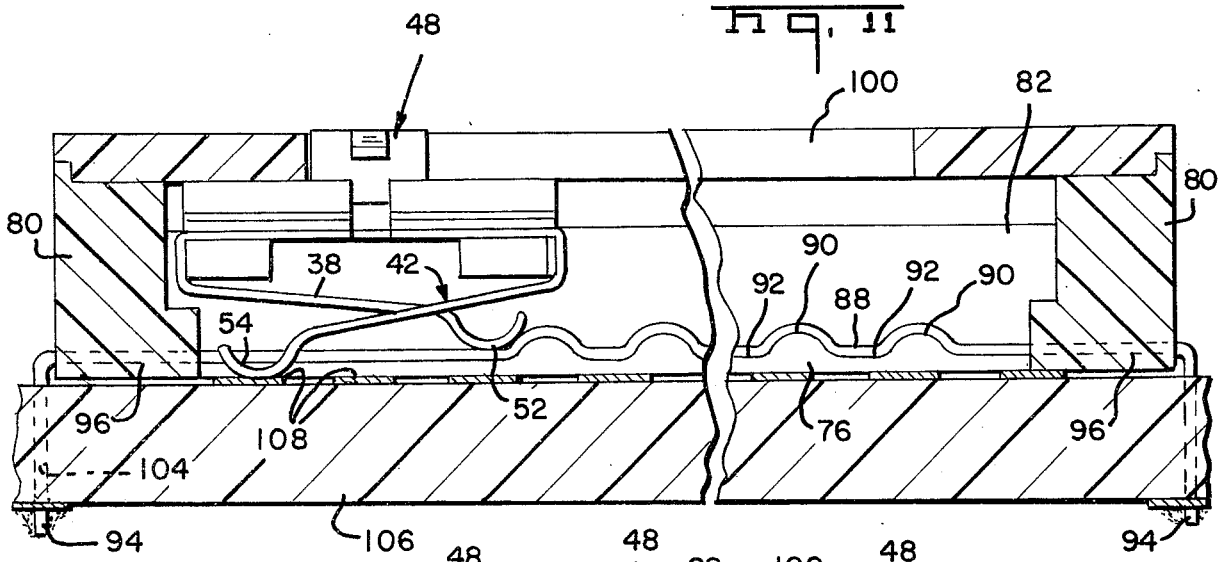
FIG. 11 is an enlarged section taken along the line 11—11 of FIG. 10.
Figure 12:
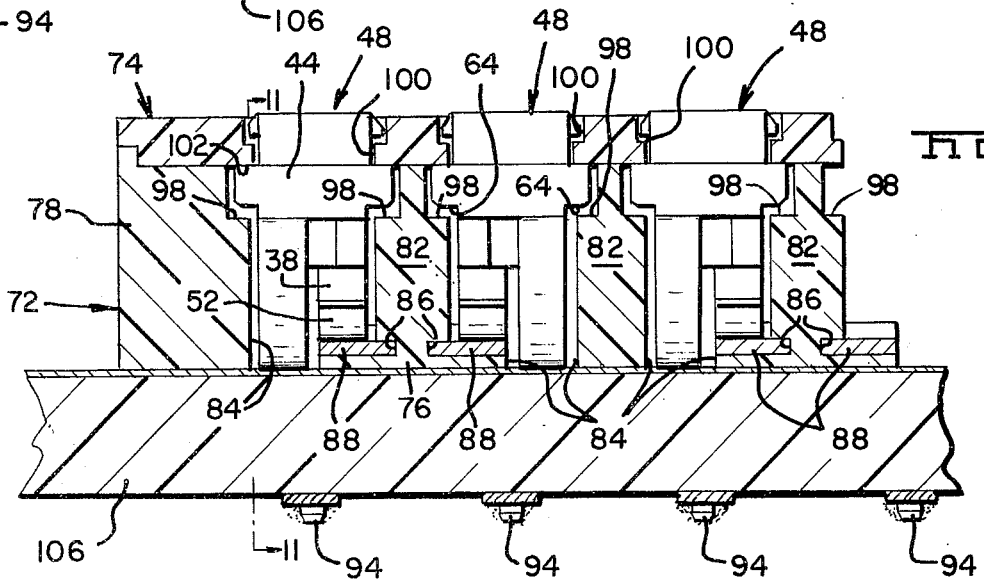
FIG. 12 is an enlarged fragmentary section taken along line 12—12 of FIG. 10.
Figure 13:
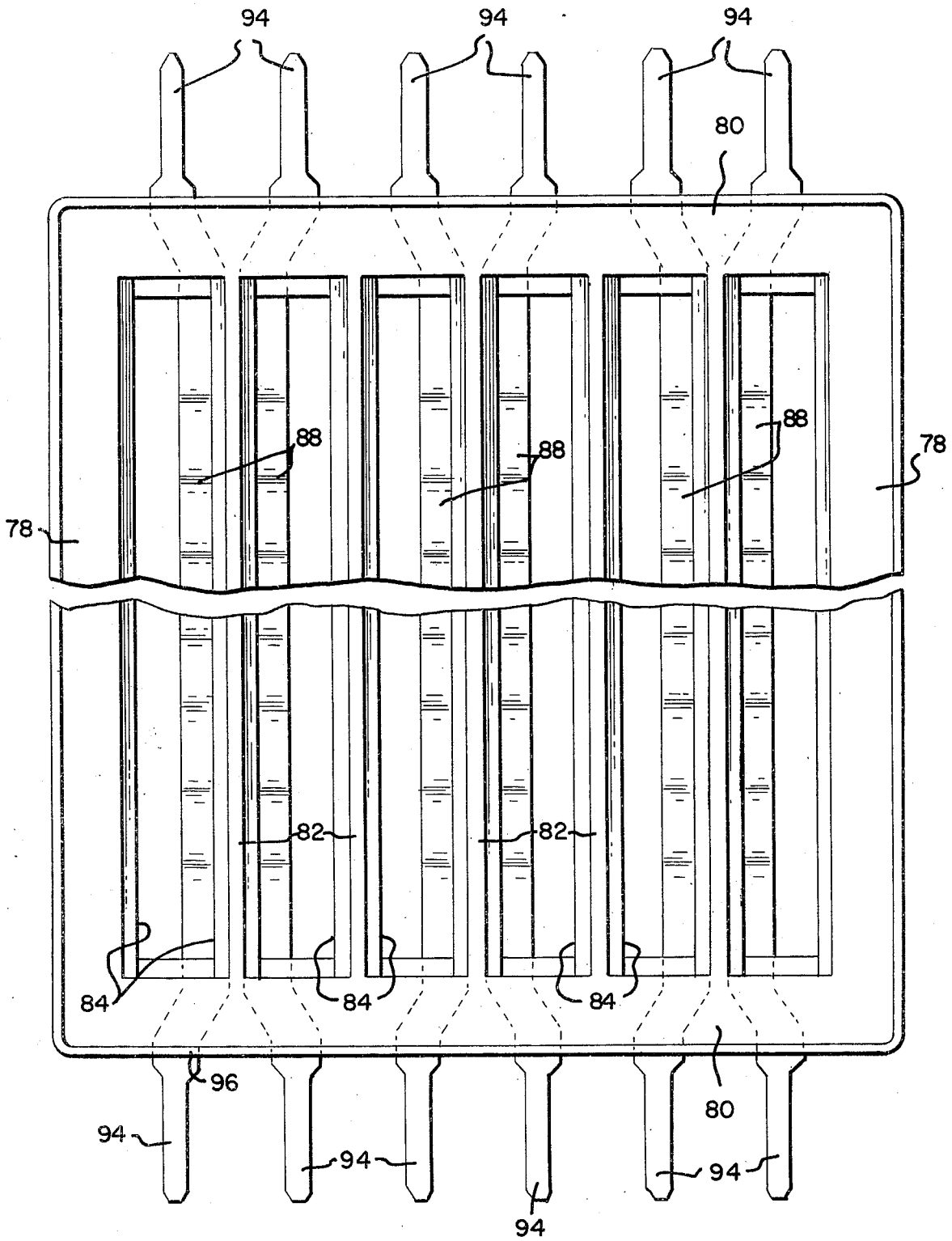
FIG. 13 is an enlarged plan view of a base portion of the preferred embodiment shown in FIGS. 10, 11 and 12.

As shown more particularly in FIG. 10, taken in conjunction with FIGS. 11, 12, and 13, another preferred embodiment of the present invention is in the form of a slide switch illustrated generally at 70. The switch includes a housing in the form of a base portion 72 and a cover portion 74. The base portion 72 includes a bottom wall 76 from which extend upright endwalls 78 and a pair of opposed sidewalls 80. The walls 76, 78, and 80 are advantageously molded from a dielectric material in integral relationship with the base. The base portion 72 further includes a plurality of spaced parallel partitions 82 which are parallel to the endwalls 78 and which are integrally connected to the sidewalls 80. The bottom wall 76 is provided with a plurality of elongated slots 84 one of which is adjacent an endwall 78. Others of the slots 84 are provided on opposite sides of alternate partitions 82. Each of the slots generally extend parallel to the partitions and the endwalls 78 and is of a width approximately half the spacing between alternate partitions and half the spacing between one of the partitions 82 and the endwall 78. In addition, the alternate partitions 82 are provided with elongated grooves 86 on opposed sides thereof. The grooves 86 are located at the top surface of the bottom wall 76 and extend at least partially into the partitions 82. As shown more particularly in FIGS. 11 and 12, the grooves receive therein elongated conducting strips 88 of metal or conducting foil or the like. The bottom wall 76 is provided with undulations which form relatively raised portions 90 alternating with relatively recessed portions 92. The strip 88 also is preformed with undulations having relatively raised portions and relatively recessed portions to correspond with those of the bottom wall 76. In addition the grooves 86 also are provided with undulating configurations conforming to the undulations in the strips 88, permitting the strips 88 to be partially inserted into the grooves 86. The bottom wall 76 and the grooves 86 thereby conform to the shape of the strips and retain the strips in place. As further illustrated the strips 88 are adjacent corresponding slots 84 provided in the bottom wall 76. The strips 88 may be embedded in place during molding of the base and integral walls. The strips 88 include a pair of end portions 94 which originally project outwardly through corresponding apertures 96 through the walls 80. The end portions 94 may be bent at 90 degrees with the surface of the bottom wall 76 to project in depending relationship for pluggable mounting to a printed circuit board. The end portions 94 thereby provide depending electrical leads on terminals for pluggable connection externally of the housing. In each of the clearances between adjacent partitions 82, and the clearances between the endwalls 78 and a partition 82, is inserted a carriage 48 which is adequately described in conjunction with the embodiment illustrated in FIGS. 1-9. Each carriage 48 includes a contact having one leaf spring or beam 38 thereof in overlying relationship with respect to a corresponding strip 88, with the arcuate ends 52 of the beam 38 engageable on the undulating surface of the corresponding strip contact 88. The other beam or leg 42 of the contact carried by the carriage 48 projects into a corresponding slot 84 of the bottom wall 76. Each of the partitions 82 and the endwalls 78 is provided with a recessed horizontal shoulder portion 98 for receiving the corresponding inverted shoulder portion 64 thereagainst. Accordingly the shoulder portions 98 serve the same purpose as the corresponding shoulder portions 62 in the embodiment of the invention described with FIGS. 1–9. The cover portion 74 is provided with stepped configuration slots 100 fore receiving the carriages 48 therein. The cover has an inverted bearing surface 102 against which the carriage body portion 44 is slidably impinged. The inherent resiliency of the beams 38 and 42 resiliently urge the carriage body portion 34 to impinge against the inverted bearing surface 102 of the cover 74.

As shown more particularly in FIG. 10 and 11, the depending terminals or leads 94 are inserted into the corresponding apertures 104 of a printed circuit board 106. The surface of the printed circuit board is provided with spaced circuit paths 108 thereon. The beam 42 of each carriage contact has its arcuate end portion 54 engageable against the surface of the printed circuit board 106, and more particularly, is adapted for electrical engagement in turn on the circuit paths 108. The cover 74 slightly compresses each of the carriages 48 downwardly within the housing of the switch. This partially compresses each of the beams 38 and 42 to assure pressure contact on the strip 88 and the selected one of the circuit paths 108, respectively. The inherent resiliency of the beams 38 and 42 resiliently urge the carriage body portion to impinge against the inverted bearing surface 102. The slight compression provided on the carriage by the cover 74 thus prevents chattering of the beams 38 and 42. The carriages 48 are adapted for slidable displacement along corresponding slots 100 with the arcuate portions 52 being forced to traverse over the undulating surfaces of the strips 88. Such displacement also will transfer the contact portion 54 of each carriage selectively into engagement with the circuit paths 108 individually in turn as the carriages are displaced along the slots 48. Registration of the contact portions 52 within relatively recessed portions of the undulating contact surfaces provides a detenting action which momentarily detents the carriages in desired positions along the slots and thereby selectively detents the contact portions 54 into electrical engagement with a corresponding selected one of the circuit paths 108. Since the beams 38 and 42 depend and extend diagonally across the bottom of each corresponding carriage portion 48 the lengths of the beams are maximized to permit a corresponding maximized resilient deflection of the beams before permanent deformation of the beams occur. The resilient cantilever deflection of each of the beams 38 as it traverses over the undulating surface of the corresponding contact strip 88 occurs without permanent deflection of the beams 38. In addition the detenting action of each of the contact portions 52 in the relatively recessed portions of the contact strips provides a positive and resilient detenting action which insures the proper indexing the corresponding carriage 48 along the slot to a desired one of a plurality of positions whereby the corresponding contact portion 54 will engage a selected one of the conducting paths 108 of the printed circuit board 106.

Figure 14:
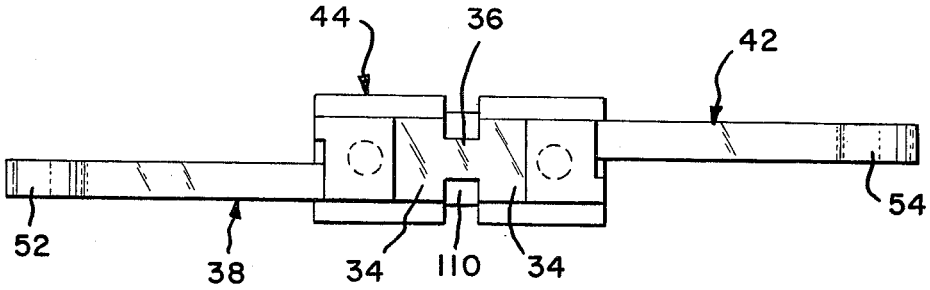
FIG. 14 is an enlarged plan of the underside of a carriage according to the present invention illustrating the contact mounted thereto.
Figure 15:
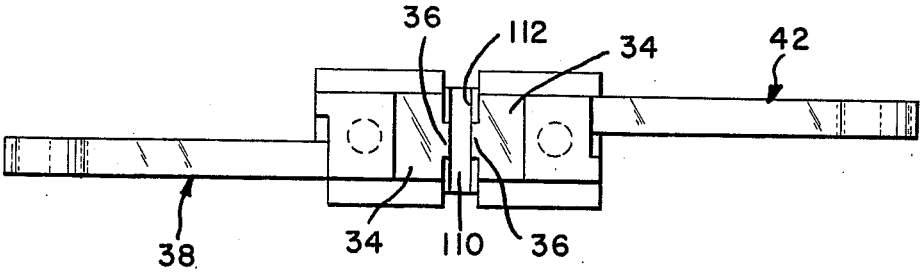
FIG. 15 is an enlarged plan of the carriage as shown in FIG. 14 with a portion of the contact removed to separate the contact into two portions.
Figure 16:
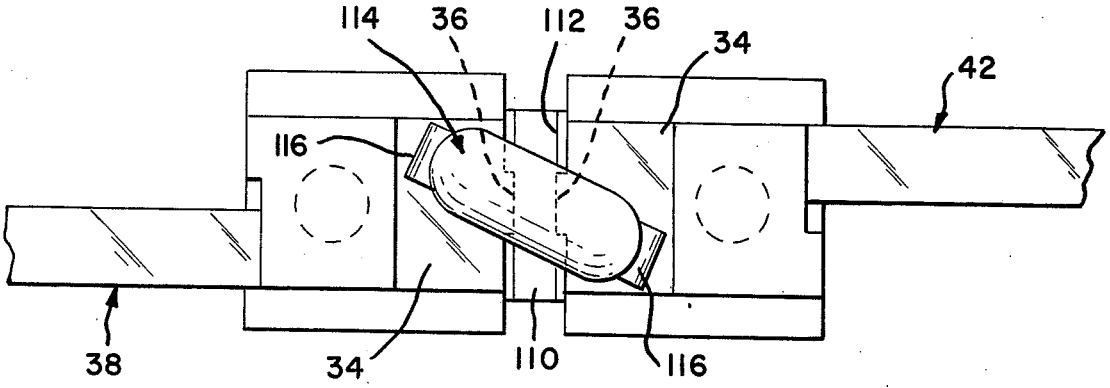
FIG. 16 is an enlarged fragmentary plan of the carriage as shown in FIG. 15 with a diode electrically connected between the separate portions of the contact.
Figure 17:
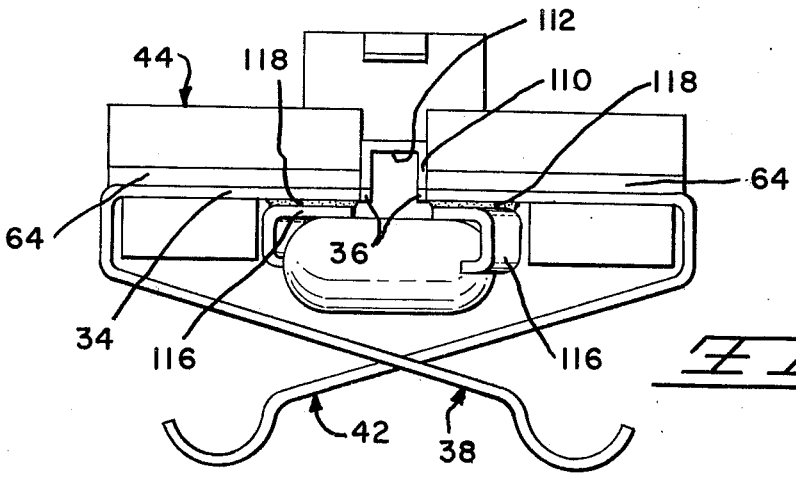
FIG. 17 is an enlarged elevation illustrating the completed carriage and diode as shown in FIG. 16.

With more particular reference to FIGS. 14–17, an alternate preferred embodiment of the carriage 44 will be described in detail. As shown in FIG. 14 the integral web portion 36 joins the contact portions 34. The web portions 36 overlies a plastic or dielectric portion 110 which is narrower than the overall width of the carriage 44. As shown in FIGS. 15–17, a mill cutter or other suitable cutting instrument (not shown) severs through the web portion 36 and provides a relatively narrow kerf 112 within the plastic portion 110. The kerf accordingly divides the web portion 36 into two separate contact portions or pieces 34. Also as shown in FIGS. 16 and 17, a diode 114 which is potted in an encapsulating material of an elongated cylindrical shape and provided with electrical leads 116 bridged across contact portions 34 with the leads 116 soldered at 118 to electrically bridge the diode leads across the contacts portions 34. Thus when an electrical circuit path is established between the beam portions 38 and 42, the circuit path polarity will be determined by the presence of the diode 114.

Figure 20:
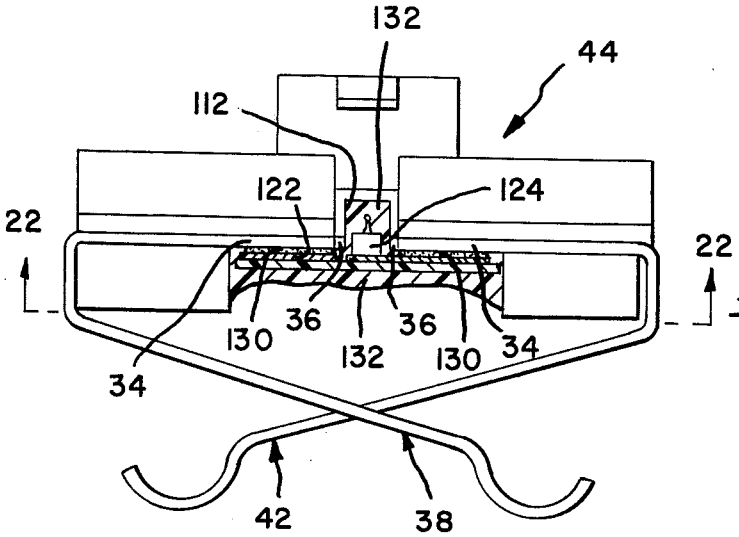
FIG. 20 is an enlarged elevation with parts in section illustrating the details of a switch according to the present invention incorporating a diode therein.
Figure 21:
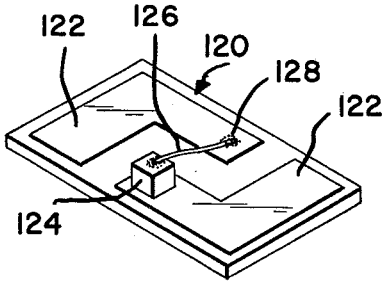
FIG. 21 is an enlarged perspective illustrating a diode of the type incorporated into the carriage as shown in FIG. 20.

With more particular reference to FIGS. 20 and 21, a further modification of the carriage 44 will be described. The carriage 44 is of a configuration similar to that shown in FIG. 15 and is modified with a diode subassembly. A small rectangular portion of a dielectric material such as KAPTON is indicated generally at 120 in FIG. 21. The KAPTON is provided thereon with a pair of L-shaped conductive pads 122 applied thereto by plating process, for example. A diode 124, which may be of the unidirectional current type or the light emitting type is soldered to one of the pads 122 and a lead 126 of the diode is soldered at 128 to the other pad 122. The subassembly of diode to KAPTON is assembled in the bottom of the carriage by soldering at 130 the respective pads 122 to the corresponding contact portions 34, with the diode 124 partially projecting into the kerf 112. The kerf 112 is then provided with a transparent encapsulant or potting material 132 and the KAPTON itself is provided thereover with potting material or encapsulant material 132. If the diode 124 is of the light emitting type the entire carriage dielectric portion 44 will be molded from a transparent material. Thus a circuit completed between the beam portions 38 and 42 will activate the light emitting diode 124 which can be visibly seen through the transparent encapsulant material 132 and the transparent carriage material.

Figure 22:
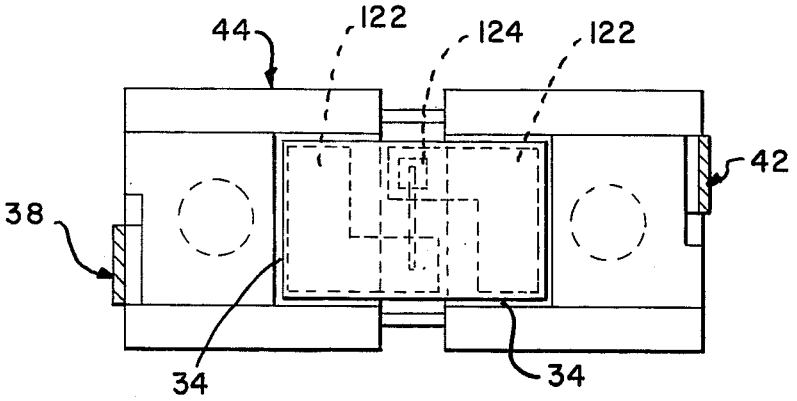
FIG. 22 is an enlarged bottom plan view of the switch carriage as shown in FIG. 20.
Figure 23:
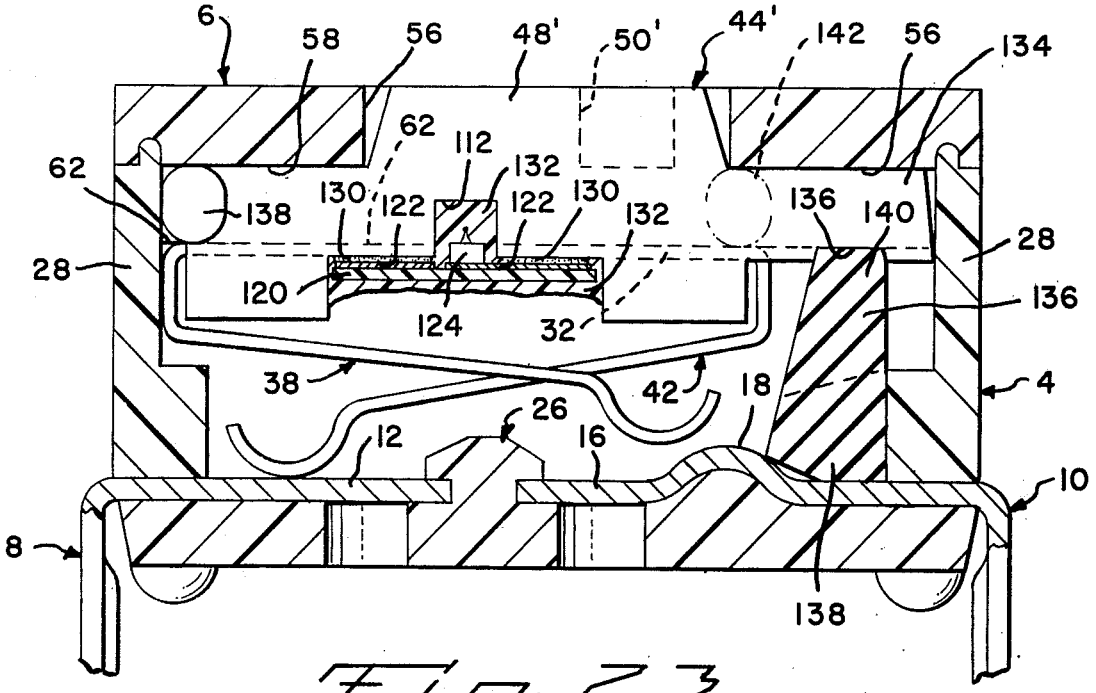
FIG. 23 is an enlarged elevation in section illustrating the carriage of FIG. 18 incorporated into a push button version of the switch according to the present invention.

With more particular reference to FIG. 23 a push button type switch according to the present invention will be described in detail. As shown in the figure, the housing portion 4 and the cover portion 6 are the same components as described in conjunction with FIG. 2. The switch includes the carriage 44′ which is modified with respect to the carriage 44 previously described. The modified carriage 44′ includes a long raised knob portion 48′ which extends substantially the length of the slot 56 provided in the cover 6. In addition the carriage 44′ has the recess 50′ located adjacent one end of the raised portion or knob 48′ and in alignment over the free end of the contact beam 38. The carriage 44′ further is provided with an elongated end portion 134 adjacent the cantilever fixed end of the beam 42. The elongated end portion 134 is provided with an inverted recess 136. A resilient block of resilient deformable material is illustrated at 136 having an end portion 138 in registration against the terminal 16, with the arcuately raised portion 18 of the terminal providing an inclined stop which tends to pivot the block 138 clockwise as shown in FIG. 23 and therefore against the end wall 4. The remaining end 140 of the block is seated within the recess 136. The other end of the carriage is provided with a pair of outwardly extending fixed axles one of which is shown at 138 adjacent the cantilever fixed end of beam 38. The axles 138 pivotably register against the shoulder portions 162 of the base 4 and are also captured under the inverted bearing surface 58 of the cover 6. As shown in FIG. 23, the beam portion 42 is resiliently engaged at all times against the corresponding terminal 12. The beam portion 38 is formed to be self supporting elevated above the terminal 16. When pressure is applied to the knob or raised portion 48′ in the vicinity of the recess 50′, the carriage 44′ will pivot about the axles 138 resiliently compressing the block 136 and pivoting the beam 38 into resilient engagement on the terminal 16, thereby completing a circuit path from the terminal 12, through the beam 42, through the beam 38 and through the terminal 16. When pressure is removed from the knob 48′ the block 136 will resiliently expand returning the carriage to its position as shown in FIG. 23 thereby disengaging the beam 38 from the terminal 16 to interrupt the electrical circuit. The switch accordingly described is of the momentary push button type. As shown in FIG. 23 the diode 124 which is soldered to the pad 122 of the KAPTON 120 may be optionally provided in the push button switch. The diode 124 is not necessary for completion of the electrical circuit as described. However if it is desired to provide the diode 124 it may be installed in the carriage 44′ in a fashion similar to that described in conjunction with FIGS. 20–22. If the diode is of the light emitting type and the carriage 44′ is fabricated from a transparent dielectric, the momentary establishment of a completed circuit as described will be indicated by the momentary lighting of the diode 124 as the circuit path is established therethrough.

With more particular reference to FIGS. 18 and 19 taken in conjunction with FIG. 23 another modification of the switch will be described in detail. In this modified embodiment there is illustrated a carriage 44′ which is similar to the carriage described in conjunction with FIG. 23 in that one end is provided with pair of axles 138 the elongated knob portion 48′ and the elongated end portion 134. The embodiment of the carriage illustrated in FIG. 18 differs from that shown in FIG. 23 in that an additional pair of axles 142 are provided at the opposite end of the carriage adjacent the extended end portion 134. The axles 142 are shown in phantom in FIG. 23 as an optional modification therein. When this modified carriage is located within the housing 4, the axles 138 as well as the axles 142 remain in seated registration against the shoulder 62 of the base portion or housing 4. The contact beams 38 and 42 remain in continuous compressed resilient engagement against the corresponding terminals 16 and 12. The diode 124 and the KAPTON strip 120 may be soldered to the contact portions 34. Accordingly when a circuit is completed through the beams 38 and 42, and accordingly across diode 124 bridging between the contact portions 34, the diode will be continuously lighted as an indication of the completed circuit.

Figure 18:
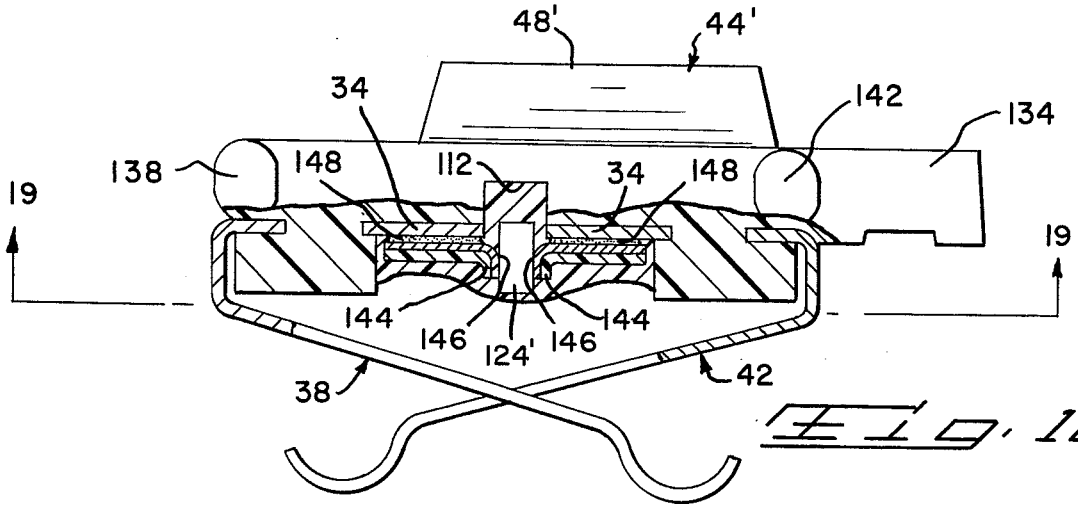
FIG. 18 is an enlarged elevation with parts partially broken away and with parts in section illustrating a carriage in the form of a stationary version of the switch according to the present invention incorporating a diode therein.
Figure 19:
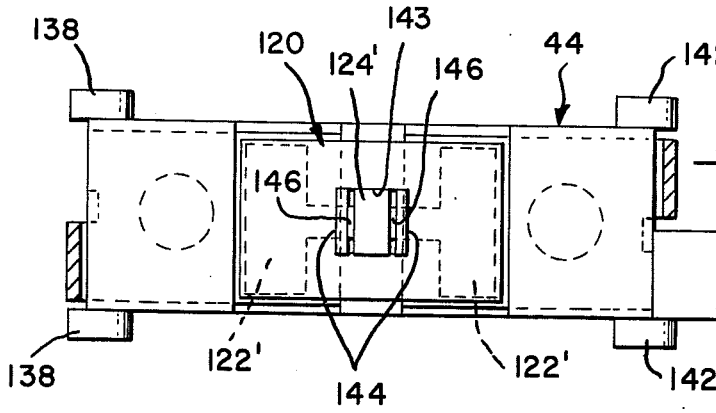
FIG. 19 is an enlarged bottom plan view of the carriage as shown in FIG. 18.

As shown in FIG. 18 and 19 an alternative form of diode 124′ is shown. Such a diode is of the leadless type and is illustrated in generally rectangular configuration. A strip of KAPTON 120, similar to the strip shown in FIG. 21 is provided thereon with generally T-shaped circuits 122′, varying somewhat from the circuits 122 of the KAPTON strip shown in FIG. 21. The KAPTON strip as shown in FIGS. 18 and 19 is provided with a central generally H-shaped slit 143 configured in a manner such that a pair of tabs 144 may be lifted and bent out of the plane of the KAPTON, which slits include thereon leg portions 146 of the T-shaped circuit pads 122′. The circuit portions 146 register against opposite sides of the diode 124′ and are soldered thereto to complete an electrical circuit across the diode. The remaining portions of the pads 122′ are soldered at 148 to the contact portions 34 such that a circuit may be completed across the contact portions 34 and through the diode 124′. Accordingly the diode 124′ or the diode 124 may be utilized in either of the carriages shown in FIGS. 18, 20, or 23.

Figure 24:
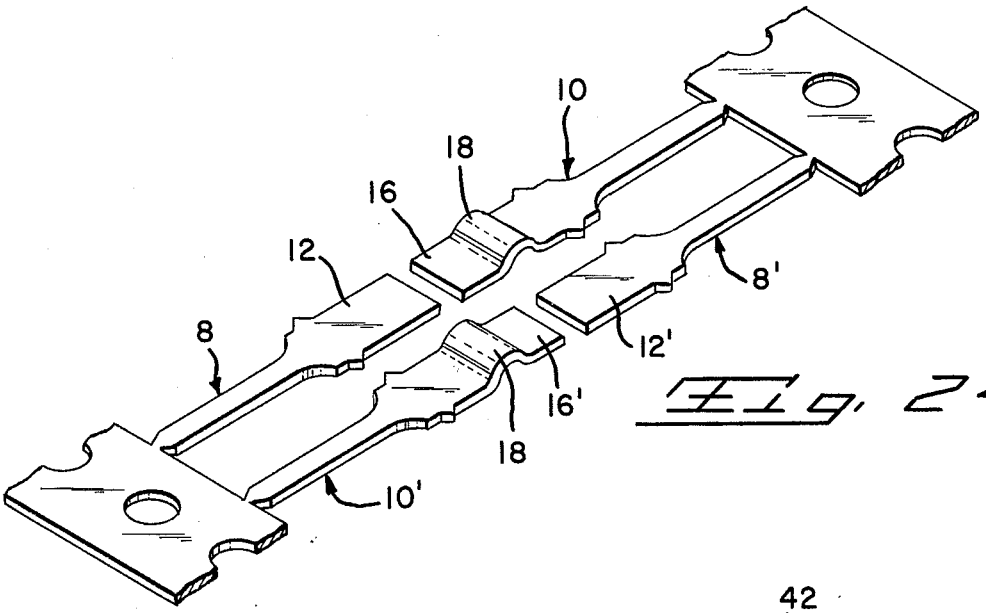
FIG. 24 is an enlarged fragmentary perspective of the electrical leads or switch poles of a single-pole, double-throw version of the switch according to the present invention.

With more particular references to FIGS. 24–26, a single pole double throw version of a switch according to the present invention will be described in detail. Such a switch is fabricated with the housing 4 and the cover 6 according to the embodiment illustrated in FIGS. 1–9. As shown in FIG. 24 a first pair of opposed terminals 8 and 10 are mounted in a housing 4 in a manner similar to that described in conjunction with the embodiment of FIGS. 1–9. Further illustrated in FIG. 24 is a second pair of terminals 8′ and 10′ which are correspondingly similar to the terminals 8 and 10. The terminals 8′ and 10′ are oppositely opposed compared to the opposed terminals 8 and 10 when mounted in the housing 4. In other words the terminal 10′ is adjacent the terminal 8 and the terminal 8′ is adjacent the terminal 10.

Figure 25:
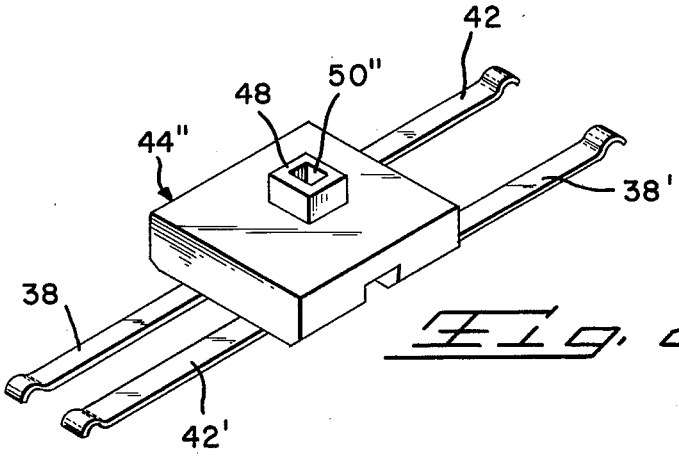
FIG. 25 is an enlarged perspective of a carriage according to a single-pole, double-throw version of the switch according to the present invention.
Figure 26:
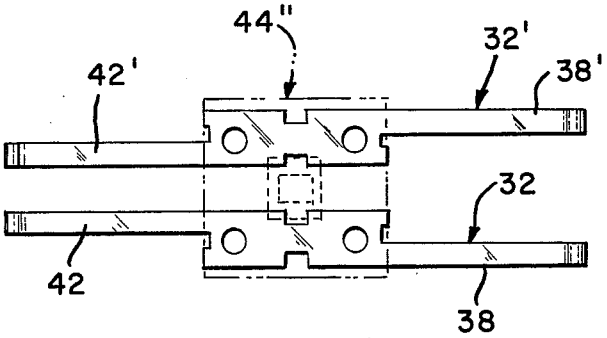
FIG. 26 is an enlarged bottom plan view of the carriage as shown in FIG. 25.

As shown in FIG. 25 a modified carriage 44″ having a knob 48″ similar to knob 48 and a recess 50″ similar to recess 50 has thereon a first contact 32 similar to the contact 32 of the embodiment previously described in conjunction with FIGS. 1–9. In addition the carriage 44′ is provided thereon with a second contact 32′ similar to the contact 32 but with the beam portions 38′ and 42′ reversed with respect to the beam portions 38 and 42 of the contact 32. Thus with the carriage 44′ mounted within a housing and provided thereover with the cover 6, the knob 48″ will protrude through a corresponding slot 56. When the knob is in one extreme position of the slot, a first circuit path will be completed through the terminal 8, the beam 42, the beam 38 and the terminal 10. With the carriage 44′ displaced to the other extreme end position of the slot 56 the first circuit path will be interrupted, for example, by the beam 42 disengaging from the terminal 8, and a second circuit path will be completed from the terminal 8', the beam 38', the beam 42' and the terminal 10'. In the first extreme position, such second circuit path will be interrupted by the beam 42' being disengaged from a corresponding terminal 8'. Thus in one extreme end position of the slot the first circuit path will be completed and the second circuit path will be interrupted. With the carriage in the second extreme end position of the slot the second circuit path will be completed and the first circuit path will be interrupted.

With more particular reference to FIGS. 27–34, a double pole, double throw version of a switch according to the present invention will be described in detail. Such a switch is illustrated generally in FIG. 28 at 150. Another switch of the double pole double throw type may be formed integrally therewith and is shown in phantom outline also at 150. Any number of switches may be formed together in a single unit.

Figure 27:
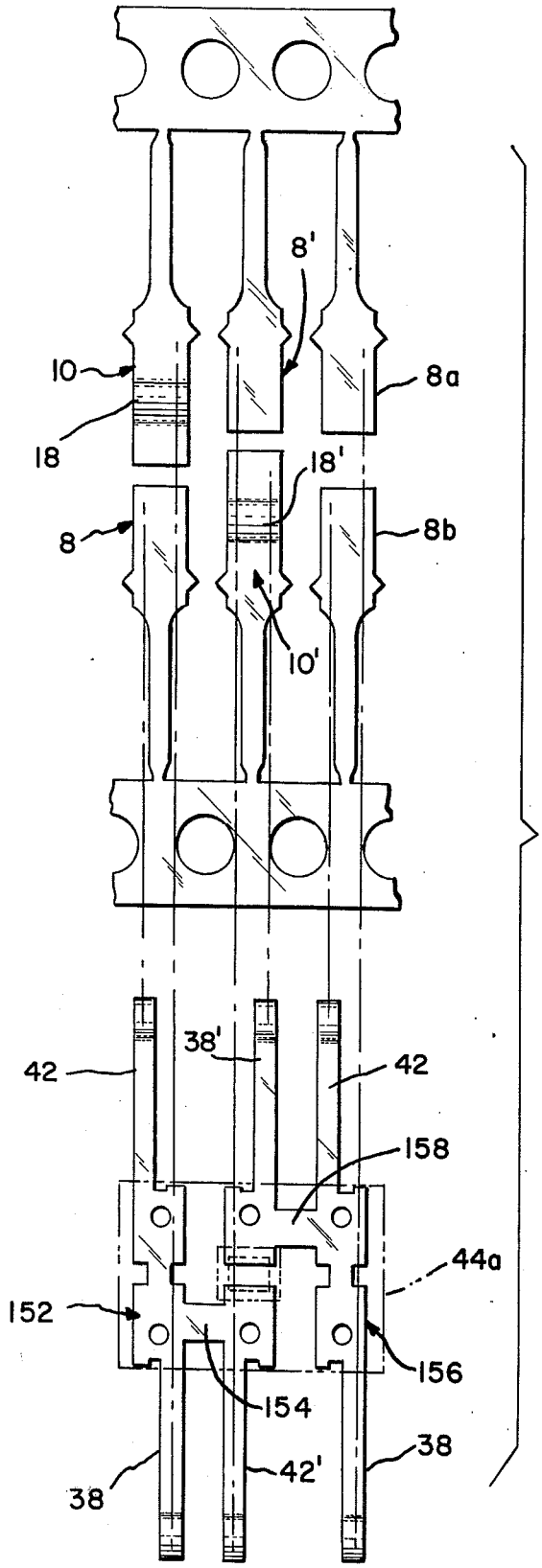
FIG. 27 is a plan of the electrical terminals or switch poles of a double-pole, double-throw version of a switch according to the present invention together with the bottom plan view of a carriage and pair of electrical contacts carried thereby according to a double-pole, double-throw version of a switch according to the present invention.
Figure 28:
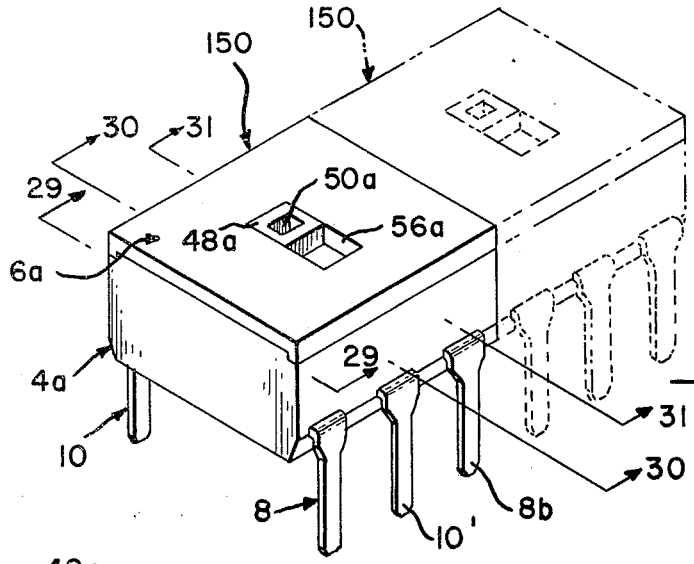
FIG. 28 is an enlarged perspective of a double-throw, double-pole version of a switch according to the present invention with an additional double-pole, double-throw switch illustrated in phantom outline.

As shown in FIGS. 27 and 28 the housing **4*a* of the switch 150 is provided with three pairs of contacts. More particularly the pair of contacts 8 and 10 and the pair of contacts 8' and 10' are arranged similarly as described in conjunction with the switch embodiment shown in FIGS. 24–26. In addition a third pair of opposed contacts 8*a* and 8*b* each of which is similar to the contact 8. The carriage illustrated generally at 44*a* includes a pair of contacts thereon. The first contact illustrated at 152 includes a first pair of beams 38 and 42 similar to the beams 38 and 42 of the embodiment as shown in FIGS. 1–9. In addition a third beam 42' is adjacent to the beam 38 and is interconnected thereto by a web portion 154. The beam portion 42' is similar to the beam 42. The second contact indicated generally at 156 includes a pair of beam portions 38 and 42 which are similar to the beam portions 38 and 42 of the embodiment described in conjunction with FIGS. 1–9. In addition the contact 156 further includes another beam portion 38' similar to the beam portion 38 but located adjacent the beam 42 and interconnected thereto by a web portion 158. The housing 150 is further provided with raised portions 26*a*, 26*b* and 26*c* each similar to the projecting portion 26 of the FIGS. 1–9** embodiment.

Figure 29:
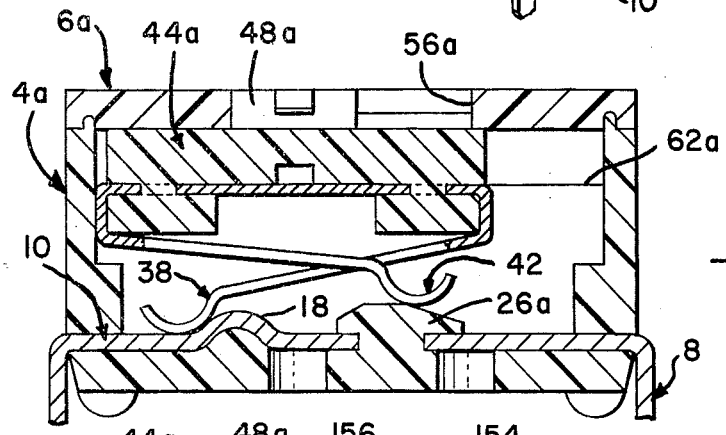
FIG. 29 is a section taken along the line 29—29 of FIG. 28.
Figure 30:
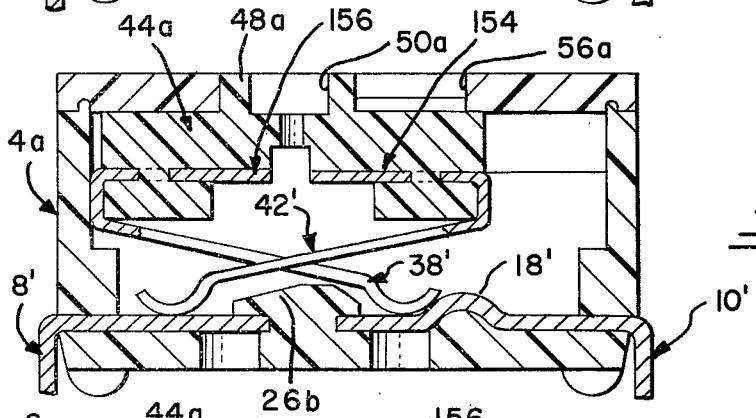
FIG. 30 is an enlarged section taken along the line 30—30 of FIG. 28.
Figure 31:
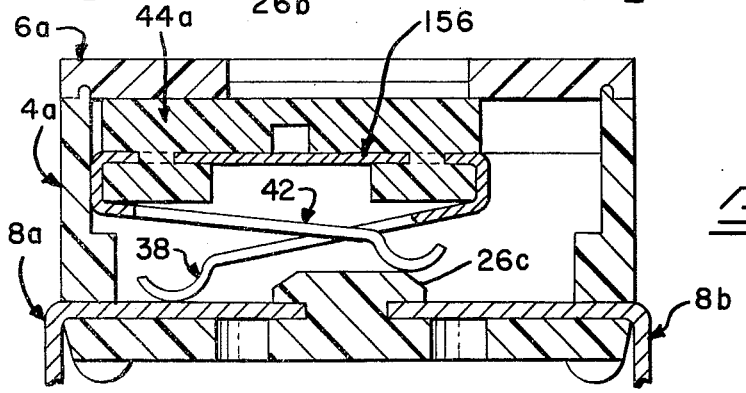
FIG. 31 is an enlarged section taken along the line 31—31 of FIG. 28.

With reference to FIGS. 29–34, the carriage **44*a* is assembled into the housing 4*a* such that the carriage slidably seats against shoulders 62*a* similar to the shoulders 62 of the embodiment shown in FIGS. 1–9. In addition the cover 6*a* partially compresses the beams 38, 42, 38', 42' resiliently toward the corresponding contacts 8, 10, 8', 10', 8*a* and 8*b*. The projecting knob or operator 48*a* located in one extreme end position of the slot 60*a* of the cover 6*a* is shown in FIGS. 29–31. As shown in FIG. 29 more particularly the contact 38 engages the contact 10 and is detented behind the raised portion 18. The contact 42 is partially deflected by the housing projecting portion 26*a*. Accordingly the beam 42 is prevented from electrical engagement with the corresponding terminal 8. As shown in FIG. 30, the beam 42' engages electrically the contact 8' and the beam 38' electrically engages the contact 10' while being detented behind the projecting arcuate raised portion 18'. Accordingly a first electrical circuit is completed from the terminal 10, through the beam 38, through the beam 42' and through terminal 8'. In addition as shown in FIG. 31, the beam 38 electrically engages the terminal 8*a* and the terminal 42 is deflected and thereby lifted by the projection 26*b*, which is similar to the projection 26 as shown in the embodiment illustrated in FIGS. 1–9. Accordingly the beam 42 is prevented from electrically engaging the terminal 8*b*. Accordingly a second electrical circuit is established through terminal 8*a*, beam 38, beam 38' and terminal 10'**.

Figure 32:
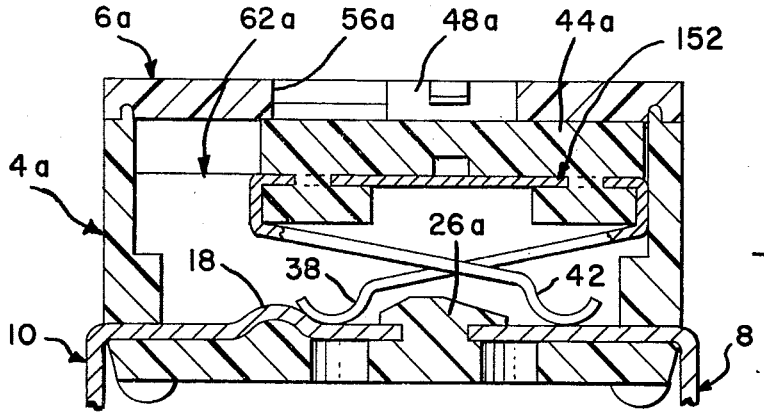
FIG. 32 is an enlarged section similar to the section of FIG. 29 illustrating the carriage in an alternate position.
Figure 33:
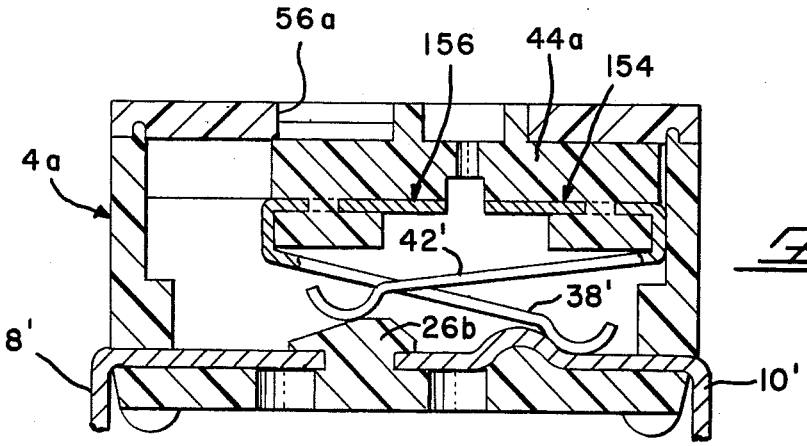
FIG. 33 is an enlarged section similar to FIG. 30 illustrating the carriage in an alternate position.
Figure 34:
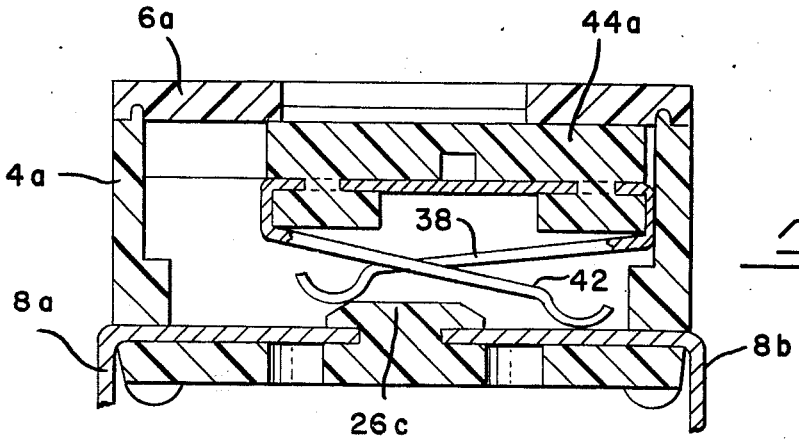
FIG. 34 is an enlarged section similar to the section of FIG. 31 illustrating the carriage in an alternate position.

With more particular reference to FIGS. 32–34, the carriage **44*a* is illustrated as being displaced from its position as shown in FIGS. 29–31 to the other extreme end position with the slot 56*a*. In this position the beam portion 42 of the contact 152 is displaced from left to right as shown in FIG. 32 where it is disengaged from the raised portion 26*a* of the housing 4*a* and is slidably engaged on the terminal 8 thereby completing a third electrical circuit from terminal 10, through beam portion 38, through the contact 152, through the beam portion 42** of the contact and through the terminals.

As shown in FIG. 33, the beam portion 42' of the contact 154 is slidably displaced from left to right where it is disengaged from the terminal 8' and is maintained in slightly deflected resilient position by projecting portion **26*b* of the base 4*a*. The first electrical circuit thereby is interrupted with the carriage 44*a*** in the alternate position.

In FIG. 34, with the carriage **44*a* in the position shown, the beam 38 is slidably displaced from left to right and disengaged from the terminal 8*a* and maintained in elevated position by resilient deflection thereof upon engagement with the projecting portion 26*c* of the base 4*a*. The second electrical circuit passing through terminal 8*a* and beam 38 is thereby interrupted. A fourth electrical circuit is completed from terminal 10', through beam 38' of the contact 156, through beam 42 of the contact 156 and through the terminal 8*b*. Accordingly with the carriage in the first position as shown in FIGS. 29–31, first and second electrical circuits are completed. With the carriage in the second position as shown in FIGS. 32–34**, third and fourth electrical circuits are completed.

Although preferred embodiments of the present invention have been described in detail other modifications and embodiments are intended to be covered by the spirit and scope of the apended claims.

What is claimed is:

1. A switch, comprising:

a housing of dielectric material, a pair of spaced terminals fixed on the housing, a slide element mounted in said housing and carrying a resiliently deflectable electrical contact, said slide element in a first position bridging said electrical contact across said terminals completing an electrical circuit therebetween, said slide element being movable to a second position disengaging said resilient electrical contact from one of said terminals to interrupt said electrical circuit, said housing having a portion thereof engaging said contact when said sliding element is in said second position to prevent chatter of said contact when subjected to vibration, said contact being divided into two separate portions, a diode, and means connecting said diode electrically between said portions of said contact.

2. The structure as recited in claim 1, wherein, said means includes a pair of leads on said diode soldered to said separate portions of said contact.

3. The structure as recited in claim 1, wherein, said means includes a dielectric strip having plating thereon soldered to said diode and to said portions of said contacts.

4. The structure as recited in claim 1, wherein, said diode is a light emitting type diode.

5. A momentary switch, comprising:

a housing, a pair of spaced terminals mounted in said housing and projecting outwardly of said housing to form electrical leads, a carriage pivotably mounted on said housing and carrying a contact provided with a pair of depending resilient beam portions, one of said beam portions resiliently engaging one of said terminals, resiliently deformable means between said housing and said carriage for maintaining the other of said beam portions initially spaced from the other of said terminals, said means being resiliently deformable upon pivoting said carriage to engage said other beam portion into electrical engagement with the other of said terminals completing an electrical circuit between said terminals.

6. The structure as recited in claim 5, wherein, said contact is divided into two separate portions, and a diode is electrically connected between said portions.

7. A double pole double throw switch, comprising:

a housing, first and second and third pairs of electrical terminals mounted on said housing, a carriage displaceably mounted on said housing and having first and second electrical contacts, each of said contacts having a first resilient finger portion engageable on a corresponding terminal of said second pair, said first contact having an opposed pair of resilient finger portions aligned with said first pair of terminals, said second contact having an opposed pair of resilient finger portions aligned with said third pair of terminals, said first contact with said carriage in a first position on said housing electrically connecting a terminal of said first pair and a terminal of said second pair completing therebetween a first electrical circuit, said second contact with said carriage in said first position connecting a first terminal of said second pair with a first terminal of said third pair completing a second electrical circuit therebetween, said first contact with said carriage in a second position on said housing engaging said first pair of terminals completing a third electrical circuit therebetween, said second contact with said carriage in said second position engaging a second terminal of said second pair and a second terminal of said third pair completing a fourth electrical circuit therebetween.

8. A switch, comprising:

a housing, a carriage manually displaceable to first and second positions in said housing, said housing containing first and second elongated terminals having portions projecting outwardly of said housing to form depending electrical leads, said first terminal having a raised portion, deflecting means in said housing adjacent said second terminal and projecting into a space defined between said carriage and said terminals, a contact having a midportion fixed to said carriage and having first and second cantilever beam portions projecting into said space, said first beam portion continuously engaging said first terminal and being detented against a first side of said raised portion with said carriage in a first position, said first beam portion being detented against a second side of said raised portion with said carriage in said second position, said second beam portion engaging said second terminal with said carriage in said first position, and with said carriage in said second position said second beam portion engaging said deflecting means and being deflected by said deflecting means out of engagement with said second terminal.

9. The structure as recited in claim 8, wherein, said second beam portion has a wiping surface which is maintained in said space when said second beam portion is deflected by said deflecting means, and when said carriage is displaced from said second position to said first position said wiping surface is brought into engagement with said second terminal and slidably engaged lengthwise along said second terminal without having engaged said housing or said deflecting means.

10. The structure as recited in claim 8, wherein, said contact midportion is stopped against a first sidewall of said housing with said carriage in said first position and said midportion is stopped against a second sidewall of said housing with said carriage in said second position.

11. The structure as recited in claim 8, wherein, said first and second beam portions extend in opposite diagonal directions in said space and are adjacent each other.

12. The structure as recited in claim 8, wherein, said housing includes a planar top surface provided with a slot therein, said carriage has a knob portion projecting into said slot for traverse therein, and a removable film of sealant material adhered to said planar top surface covering said knob and said slot.

13. The structure as recited in claim 8, wherein, said carriage comprises a dielectric body having said contact embedded therein, and said housing comprises, firstly a dielectric base having said terminals embedded therein, and secondly a cover of dielectric material which overlies said carriage and which provides a sliding bearing surface engaged against said carriage.

14. The structure as recited in claim 8, wherein, said second beam portion has a wiping surface slidably traversed over said second terminal as said carriage is displaced between said first and said second positions, when said carriage is displaced from said first to said second position said deflecting means engages said second beam portion at a location remote from said wiping surface to deflect said second beam portion, and said wiping surface being maintained in said space upon deflection of said second beam portion without having engaged either said housing or said deflecting means.

15. A slide switch, comprising:

a base provided with a plurality of discrete circuit elements, a cover, a terminal of unitary elongated strip form provided with serially arranged undulations defining relatively recessed portions and alternating relatively raised portions, said terminal being contained in said cover mounted on said base, said cover being provided with a slot, a carriage mounted in said cover for traverse lengthwise of said terminal strip, said carriage having a knob portion projecting in said slot for slidable traverse therein, and a contact having a midportion fixed to said carriage, said contact further having first and second projecting beam portions projecting diagonally in opposite directions, a free end of said first beam portion continuously engaging said terminal strip and being slidable lengthwise over said terminal strip for detenting registration in turn within each of said relatively recessed portions upon traverse of said carriage, and a free end of said second beam portion engaging each of said circuit elements in turn upon traverse of said carriage.

16. The structure as recited in claim 15, wherein, said first and second beam portions extend in opposite diagonal directions and are adjacent each other.

17. The structure as recited in claim 8, and further including:

third and fourth elongated terminals in said housing having portions projecting outwardly of said housing forming additional electrical leads, said fourth terminal having an additional raised portion, an additional deflecting means in said housing adjacent an end of said third terminal and projecting into said space, an additional contact having a midportion fixed to said carriage and third and fourth cantilever beam portions projecting into said space, said fourth beam portion continuously engaging said fourth contact and being detented against one side of said additional raised portion with said carriage in said first position and being detented against another side of said additional raised portion with said carriage in said second position, said third beam portion engaging said third terminal with said carriage in said second position, and with said carriage in said first position said third beam portion engaging said additional deflecting means and being deflected by said additional deflecting means out of engagement with said second terminal.

* * * * *